United States Patent [19]

Basel et al.

[11] Patent Number: 4,962,537

[45] Date of Patent: Oct. 9, 1990

[54] SHAPE ADAPTABLE IN-THE-EAR HEARING AID

[75] Inventors: Rainer Basel; Helmut Lebisch, both of Erlangen, Fed. Rep. of Germany

[73] Assignee: Siemens Aktiengesellschaft, Berlin and Munich, Fed. Rep. of Germany

[21] Appl. No.: 245,648

[22] Filed: Sep. 16, 1988

[30] Foreign Application Priority Data

Sep. 25, 1987 [DE] Fed. Rep. of Germany ... 8712957[U]

[51] Int. Cl.[5] ..... H04R 25/00

[52] U.S. Cl. ..... 381/68.6; 381/69; 381/69.2

[58] Field of Search ..... 381/68.6, 68, 69, 69.1, 381/69.2

[56] References Cited

U.S. PATENT DOCUMENTS

| | | | |
|---|---|---|---|
| 2,787,670 | 4/1957 | Rowland | 381/68.6 |
| 3,513,269 | 5/1970 | Wilson | 381/68.6 |
| 3,527,901 | 9/1970 | Geib | 381/68.6 |
| 3,890,474 | 6/1975 | Glicksberg | 381/72 |
| 4,520,236 | 5/1985 | Gauthier | 381/68.6 |
| 4,617,429 | 10/1986 | Bellafiore | 381/68.6 |
| 4,712,245 | 12/1987 | Lyregaard | 381/68.6 |
| 4,716,985 | 1/1988 | Haertl | 381/68.6 |
| 4,729,451 | 3/1988 | Brander et al. | 381/69 |
| 4,739,512 | 4/1988 | Hartl et al. | 381/69 |

FOREIGN PATENT DOCUMENTS

| | | | |
|---|---|---|---|
| 245741 | 11/1987 | European Pat. Off. | 381/68.6 |
| 245742 | 11/1987 | European Pat. Off. | 381/68.6 |
| 270268 | 6/1988 | European Pat. Off. | 381/68 |
| AS1088561 | 9/1960 | Fed. Rep. of Germany . | |
| 3616648 | 11/1987 | Fed. Rep. of Germany | 381/68.6 |
| 1111748 | 5/1968 | United Kingdom . | |
| 8707465 | 12/1987 | World Int. Prop. O. . | |
| 8803740 | 5/1988 | World Int. Prop. O. . | |

OTHER PUBLICATIONS

"Verfahren zum herstellen eines Ohrstueckes for ein Hoergeraet, " from "Nues aus der Technik," No. 2, May 15, 1986, p. 2.

*Primary Examiner*—Jin F. Ng
*Assistant Examiner*—Danita R. Byrd
*Attorney, Agent, or Firm*—Hill, Van Santen, Steadman & Simpson

[57] ABSTRACT

An in-the-ear hearing aid has a number of electrical and electro-mechanical discrete components embedded in a flexible plastic compound. The combination of the components in the plastic compound can be introduced into the user's ear, or into a negative of an ear impression, for pre-fitting. Due to the flexibility of the plastic compound, the combination can be shaped as needed. The shaped combination is then cast in an otoplastic material which conforms precisely to the shape of the user's ear, and hardens to retain that shape. A rigid shell for holding the components is thus not needed, and therefore the hearing aid is far more adaptable to different shapes of auditory canals than conventional hearing aids.

8 Claims, 1 Drawing Sheet

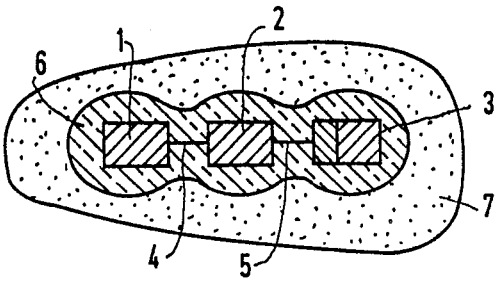
FIG 1
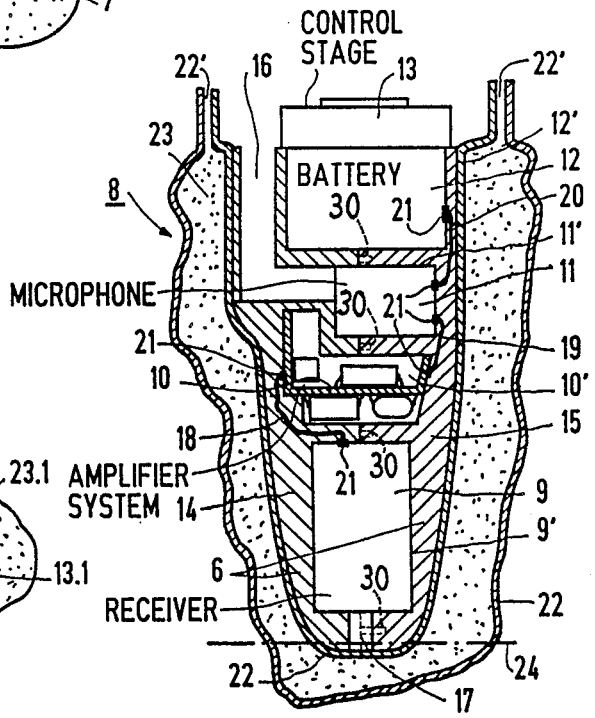
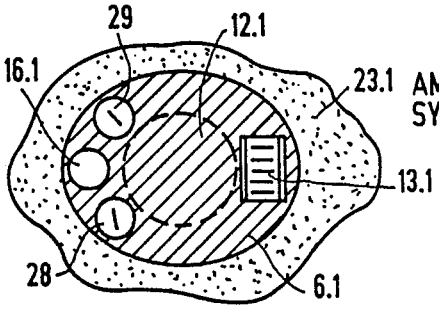
FIG 4
FIG 2
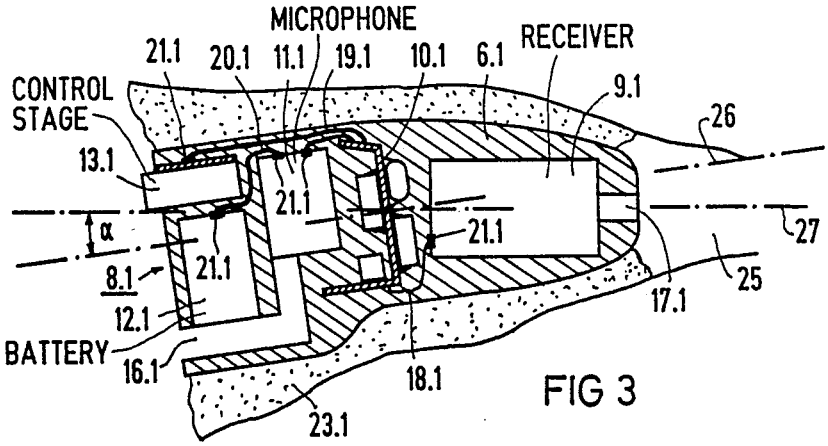
FIG 3

SHAPE ADAPTABLE IN-THE-EAR HEARING AID

BACKGROUND OF THE INVENTION

1. Field of the Invention

The present invention is directed to a hearing aid of the type worn in the ear, i.e., at least partially in the auditory canal, of a user.

2. Description of the Prior Art

An in-the-ear hearing aid is described in European Application No. 0 206 213, corresponding to U.S. Pat. No. 4,739,512, wherein a relatively small-diameter portion of the hearing aid housing, which contains the earphone, is rotatably and pivotably joined via a movable mount to a larger-diameter portion of the hearing aid housing, which contains the remaining components. The two housing portions can thus assume different angles and/or rotational directions relative to each other, so that the hearing aid can be better adapted to the shape of the auditory canal of the user.

SUMMARY OF THE INVENTION

It is an object of the present invention to provide an in-the-ear hearing aid which is even more adaptable to various shapes of the auditory canal of a user than known hearing aids.

The above object is achieved in accordance with the principles of the present invention in an in-the-ear hearing aid wherein all components, electrical and electromechanical, are contained, or potted, in a flexible plastic compound. All of the components are elastically connected to each other, i.e., the components can be moved, within limits, relative to each other while still maintaining the necessary electrical connections. The components contained within the plastic compound can be preliminarily roughly shaped to conform to the auditory canal of a user by placing and shaping the components in the plastic compound in the auditory canal of a user, or in a negative of an impression of the canal. The components in the plastic compound, thus shaped, are then cast in a conventional otoplastic material, which precisely conforms to the shape of the auditory canal so that the remainder of the volume between the roughly-shaped components in the flexible plastic compound is filled with the otoplastic material, which is then cured to harden in a shape exactly conforming to the auditory canal.

The hearing aid constructed of individual modules thus does not require rigid shells to contain the components, and is particularly pliable to every curvature of the auditory canal as a consequence of the elastic joining of the components. Moreover, surrounding the components in the flexible plastic compound has the additional advantage of minimizing feedback, since such plastic compounds attenuate feedback.

The flexible plastic compound may be cast around the components in one piece, or can be divided into two mating halves, and may be previously provided with electrical connecting lines to simplify the manufacture and maintenance of the hearing aid. It is no longer necessary to arrange the components precisely next to each other while observing extremely close tolerances. Instead, the components are simply plugged into prescribed recesses in the pre-formed halves. For repair, malfunctioning components can be simply removed from the opened halves, and replaced.

Moreover, the hearing aid may be manufactured as a so-called "throw-away" device. This device is relatively inexpensive to manufacture so that repair costs, given a failure of the device, would be uneconomical in comparison to the cost of acquiring a new hearing aid.

DESCRIPTION OF THE DRAWINGS

FIG. 1 is a sectional view showing the basic components of an in-the-ear hearing aid constructed in accordance with the principles of the present invention.

FIG. 2 is a longitudinal sectional view through an in-the-ear hearing aid constructed in accordance with the principles of the present invention showing further details thereof.

FIG. 3 is a longitudinal section through an in-the-ear hearing aid constructed in accordance with the principles of the present invention in place in the auditory canal of a user.

FIG. 4 is an end view of the hearing aid of FIG. 3.

DESCRIPTION OF THE PREFERRED EMBODIMENTS

The principles of construction of the in-the-ear hearing aid disclosed herein are schematically shown in FIG. 1. Electrical and electro-mechanical components, schematically indicated as components 1, 2 and 3, are embedded in a flexible plastic member 6. These components which may be, for example, receiver, microphone, amplifier and battery, are electrically connected to each other via electrical lines 4 and 5, also embedded within the plastic member 6. The components and electrical lines may be cast using injection or dipping methods, or the plastic member 6 may be pre-formed in two halves, which are provided with recesses into which the components 1, 2 and 3 can be inserted. The electrical connecting lines 4 and 5 can already be embedded in the halves before insertion of the components. The halves are then joined to each other, with the components and electrical lines embedded therein.

For pre-fitting to the auditory canal of a user, the plastic member 6, with the flexibly joined components 1, 2 and 3 embedded therein, are inserted either directly into the auditory canal of a hearing-impaired user, or into a negative of a preliminary impression of the auditory canal of such a person, and are manipulated until the plastic member 6, with the components therein, is optimally matched to the length and angle of the canal. The remaining space between the plastic member 6 and the walls of the canal is filled with an otoplastic material 7, which hardens after a given time.

Further structural details of the hearing aid, generally referenced 8, are shown in FIG. 2. The hearing aid contains a receiver 9, an amplifier system 10, a microphone 11, a battery 12, and a control stage 13, which includes an actuator and a potentiometer (not separately shown). In this embodiment, the plastic member 6 is divided into two halves 14 and 15 which may be held together, for example, by plug connections 30. The halves 14 and 15 are provided with recesses 9', 10', 11' and 12' which respectively hold the receiver 9, the amplifier system 10, the microphone 11 and the battery 12. A sound entry channel 16 proceeds to the microphone 11, and a sound exit 17 proceeds from the receiver 9 through the halves 14 and 15. Electrical lines 18, 19 and 20 connect the electrical terminals 21 in the recesses 9' through 12', and thus the components mounted therein, to each other, and are situated in the plastic compound comprising the shells 14 and 15. The halves 14 and 15 preferably consist of a cold-vulcanized silicon rubber having a hardness of Shore A between 30 and 50.

After completion of the shaping of the plastic member 6 in the ear (or in the negative of the impression of the ear) of the user, a sleeve 22 is drawn over the plastic member 6. The sleeve 22 may be single-walled or, as shown in FIG. 2, double-walled. The sleeve 22 preferably consists of a synthetic rubber having a wall thickness between 25 μm and 0.2 mm. The sleeve 22 should be easily stretchable, but resistant to tearing. After the plastic member 6 has been adapted to the shape of the auditory canal, the sleeve 22 is filled with otoplastic material 23 via filling openings 22', until the sleeve 22 presses against the walls of the auditory canal. The otoplastic material 23, which is initially fluid, is subsequently hardened using known processes, for example, light curing process if the material contains a photoinitiator, or a chemical curing if the material consists of two mixed components. As soon as the otoplastic material 23 has completely hardened, the hearing aid 8 is removed from the auditory canal so that the sleeve 22 can be removed. The sound exit 17 is also exposed at this time, for example, by removing all material below the section line 24 by cutting.

The sleeve 22 may be omitted if the final shaping is undertaken in a negative of an ear impression. The sleeve 22 may also be omitted if the final shaping is undertaken directly in the ear of the user, if a sufficiently viscous otoplastic material is used, so that the material cannot flow into the inner auditory canal. Such an alternative is shown in FIG. 3, wherein the hearing aid 8.1, shown in longitudinal section, is seated in the auditory canal 25 of a patient without a sleeve, and is surrounded by otoplastic material 23.1 on all sides.

The plastic member 6.1 in the embodiment of FIG. 3 is modified in comparison to the embodiment of FIG. 2. In the embodiment of FIG. 3, the earphone 9.1, the amplifier system 10.1, the microphone 11.1 and the control stage 13.1 are cast in the plastic compound comprising the plastic member 6.1. In this embodiment, the elements to be cast are first electrically connected, and the connected structure is then cast with a dip or injection method. The plastic member 6.1 in the embodiment of FIG. 3 is thus continuous, rather than consisting of two joined halves. Because the cast elements are no longer accessible, this device is intended as a throw-away device.

The cast elements are also slightly differently arranged in the embodiment of FIG. 3. In the embodiment of FIG. 2, these elements are approximately arranged following each other, resulting in an especially small-diameter device. This is particularly useful for patients having small auditory canals. The elements 9.1 through 13. 1 in the embodiment of FIG. 3, however, need not be arranged in this manner. For patients having larger auditory canals, the arrangement of FIG. 3 may be more preferable. In the embodiment of FIG. 3, for example, the control stage 13.1 is arranged next to the battery 12.1, instead of above the battery. The angling of the components in FIG. 3, as indicated by lines 26 and 27, is also intended only as an example. The angle $\alpha$ between lines 26 and 27 may assume a value of up to approximately 45° in all directions.

A front view of the hearing aid 8.1 of FIG. 3 is shown in FIG. 4. As can be seen, the actuators 28 and 29 are disposed remote from the remainder of the control stage 13.1, which contains the potentiometer. The portion of the control stage 13.1 containing the potentiometer is arranged next to the battery 12.1 (shown in dashed lines) opposite the sound entry channel 16.1. The actuators 28 and 29 are situated next to the sound entry channel 16.1. Such an arrangement of parts has the advantage, compared to the embodiment of FIG. 2, that the controls project to a lesser extent beyond the surface of the device, and thus contribute to making the device less noticeable when worn.

Although modifications and changes may be suggested by those skilled in the art it is the intention of the inventors to embody within the patent warranted hereon all changes and modifications as reasonably and properly come within the scope of their contribution to the art.

We claim as our invention:

1. A hearing aid to be worn to least partially in the auditory canal of a user, said hearing aid comprising:

a plurality of electrical components connected together with flexible electrical lines;

a pliable member in which said electrical components and lines are embedded, said pliable member having a size smaller than said auditory canal permitting said components to be roughly positioned to conform to the shape of said auditory canal;

said pliable member consisting of first and second joined halves, said first half having a plurality of recesses therein respectively conforming to the shape of said electrical components, and said second half forming a cover for said first half; and a hardened otoplastic material surrounding said pliable member and filling the volume between said pliable member and the wall of said auditory canal.

2. A hearing aid as claimed in claim 1, wherein said electrical components project from said recesses of the first half of said pliable member, and wherein the second half of said pliable member has also a plurality of recesses conforming to the shape of said electrical components.

3. A hearing aid as claimed in claim 1, wherein said electrical lines are disposed between said recesses in said pliable member.

4. A hearing aid as claimed in claim 1 further comprising means for detachably joining said halves.

5. A hearing aid as claimed in claim 1, wherein said pliable member is a seamless member in which said components and lines are embedded.

6. A hearing aid as claimed in claim 1, wherein said pliable member consists of a plastic compound.

7. A hearing aid as claimed in claim 6, wherein said plastic compound consists of cold-vulcanized silicon rubber having a hardness of Shore A between 30 and 50.

8. A hearing aid as claimed in claim 1, wherein said otoplastic material includes a curable silicon compound.

* * * * *